United States Patent [19]

Morohashi

[11] 4,238,161

[45] Dec. 9, 1980

[54] SPOTTING DEVICE

[75] Inventor: Kazuo Morohashi, Yokohama, Japan

[73] Assignees: Nippon Kogaku K.K.; Shachihata Industrial Co., Ltd., both of Japan

[21] Appl. No.: 14,850

[22] Filed: Feb. 26, 1979

Related U.S. Application Data

[63] Continuation of Ser. No. 805,565, Jun. 10, 1977, abandoned.

[30] Foreign Application Priority Data

Jun. 12, 1976 [JP] Japan ..... 51/75696

[51] Int. Cl.[3] ..... B43K 27/08

[52] U.S. Cl. ..... 401/35; 401/272; 401/264; 401/9; 401/54

[58] Field of Search ..... 401/54, 33–35, 401/272, 22, 9, 264, 266

[56] References Cited

U.S. PATENT DOCUMENTS

| | | | |
|---|---|---|---|
| 1,156,860 | 10/1915 | Heylmnn | 401/54 |
| 2,362,582 | 11/1944 | Pearson | 401/54 |
| 2,369,224 | 2/1945 | Ferger | 401/54 |
| 2,396,058 | 3/1946 | Rath | 401/198 |
| 2,456,687 | 12/1948 | Domingnez | 401/264 |
| 2,511,202 | 6/1950 | Fulboam | 401/52 |
| 3,442,595 | 5/1969 | Dumas | 401/35 |
| 3,637,316 | 1/1972 | Bross | 401/198 |
| 3,778,495 | 12/1973 | Woolley | 401/292 |
| 3,864,183 | 2/1975 | Hori | 401/198 |

FOREIGN PATENT DOCUMENTS

| | | | |
|---|---|---|---|
| 200329 | 11/1955 | Australia | 401/206 |
| 2616439 | 10/1977 | Fed. Rep. of Germany | 401/34 |
| 1342220 | 9/1963 | France | 401/35 |
| 2384635 | 11/1978 | France | 401/54 |
| 761065 | 11/1956 | United Kingdom | 401/272 |

*Primary Examiner*—William Pieprz

*Attorney, Agent, or Firm*—Fitzpatrick, Cella, Harper & Scinto

[57] ABSTRACT

In a device for spotting with ink which comprises a plurality of hollow cylinders each having a small aperture at the end thereof and means for holding the hollow cylinders in parallelism to one another and for sliding movement axially of the cylinders, there is provided an ink reservoir member disposed within each of the hollow cylinders and containing ink therein, and a spotting member disposed within each of the hollow cylinders with one end thereof engaged with the ink reservoir member and the other end projected from the small aperture. The spotting member is formed of an elastic material having a number of communication pores for directing the ink therethrough from the one end to the other end of the spotting member.

7 Claims, 1 Drawing Figure

SPOTTING DEVICE

This application is a continuation of application Ser. No. 805,565, filed June 10, 1977, now abandoned.

BACKGROUND OF THE INVENTION

1. Field of the Invention

This invention relates to a spotting device, and more particularly to a device for spotting on a curved surface such as lens surface or the like.

2. Description of the Prior Art

Most of the spotting devices according to the prior art have adopted the method comprising dipping a rod into a body of ink contained in an ink pot, impregnating the end of the rod with ink and forming an ink spot on a lens by means of the inked rod. Such a method has suffered from disadvantages that the rod must be dipped in the ink pot each time spotting is effected, that the ink is fast to dry in the ink reservoir formed in the spotting device and further that the spot formed on the lens is variable by the amount of ink on the rod.

Some of the spotting devices according to the prior art have been provided by fibrous structure having an absorbing property like a felt pen and impregnated with ink. With such spotting devices, it is desirable to use water ink having good shiftability. However, water ink is fast to dry and has necessitated the use of a cap. This in turn has led to the necessity for the user to take the trouble of attaching and detaching the cap each time he uses the spotting device.

SUMMARY OF THE INVENTION

The present invention has, for its object, to provide a spotting device which is free of drying of ink even without a cap and which can be automatically supplied with ink and ensure spots of equal size to be marked on lenses.

To achieve such an object, the spotting device of the present invention comprises a plurality of hollow cylinders each having a small aperture at the end thereof, means for holding the hollow cylinders in parallelism to one another and for sliding movement axially of the cylinders, an ink reservoir member disposed within each of the hollow cylinders and containing ink therein, and a spotting member disposed within each of the hollow cylinders with one end thereof engaged with the ink reservoir member and the other end projected from the small aperture. The spotting member may be formed of an elastic material having a number of communication pores for directing the ink therethrough from the one end to the other end.

The invention will become more fully apparent from the following detailed description thereof taken in conjunction with the accompanying drawings.

DESCRIPTION OF THE PREFERRED EMBODIMENTS

Figure 1:
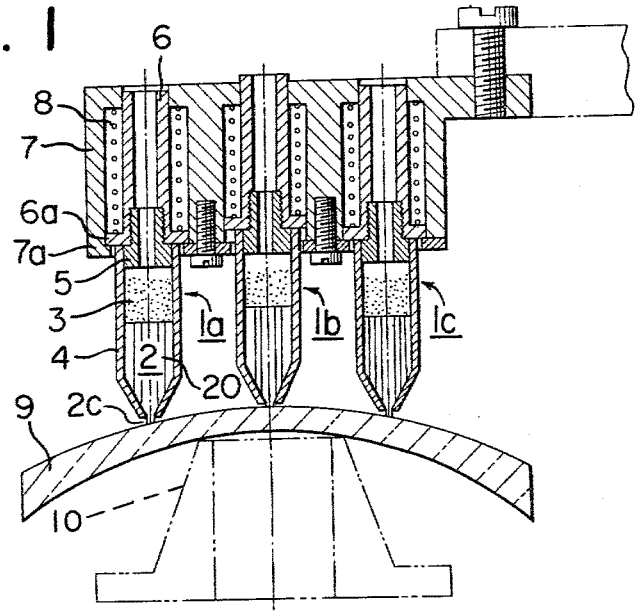
FIG. 1 is a cross-sectional view of the spotting device according to a first embodiment of the present invention.
Figure 2:
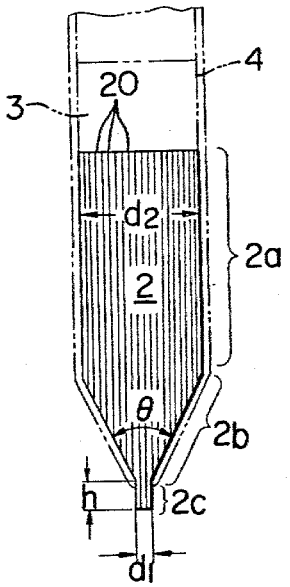
FIG. 2 is an enlarged cross-sectional view showing the shape of the spotting device according to the first embodiment of the present invention.

Referring to FIG. 1, it shows the spotting device according to a first embodiment of the present invention which is usually used with a lens meter 10. This device comprises three spotters 1*a*, 1*b* and 1*c* each having a spotting member 2 therein. Each spotting member 2, as shown in FIG. 2, is formed of an elastic material such as porous rubber having therein a number of pores 20 communicating from the upper end to the lower end, and comprise a first pillar portion 2*a*, a conical portion 2*b* and a second pillar portion 2*c* smaller in diameter than the first pillar portion 2*a*.

The upper end of the first pillar portion 2*a* is in contact with an ink reservoir member 3 equal in diameter thereto, and the numerous communication pores 20 direct the ink therethrough from the reservoir member 3 to the lower end of the second pillar portion 2*c*.

A holder 4 is provided to hold the spotting member 2 integrally with the ink reservoir member 3, and the lower end of the holder 4 surrounds and supports the second pillar portion 2*c* of the spotting member 2.

When the second pillar portion 2*c* of the spotting member 2 is urged against a body to be spotted, the portion of the ink contained therewithin is deposited on that body, so that the amount of the ink within the second pillar portion 2*c* is sharply decreased while, at the same time, the porous rubber becomes compressed. After the spotting, when the spotting member is released from its compressed state, a portion of the ink stored in the ink reservoir member 3 shifts downwardly along the communication pores 20 and again fills the second pillar portion 2*c* due to its pumping action. At this point, the communication pores 20 of course direct the ink therethrough from the ink reservoir member 3 to the second pillar portion 2*c*, but that portion of the ink flowing out through the communication pores 20 exposed on the taper of the conical portion 2*b* is directed along the taper down to the second pillar portion 2*c*.

In order that the ink reservoir member 3 may be stably maintained within the holder 4, as described above, an intermediate member 5 having the same diameter as the reservoir member 3 is integrally formed with the holder 4.

The upper end of the intermediate member 5 is formed with external thread, as shown. A cylindrical member 6 formed with internal thread engaged with said external thread is received in a main body 7. Thus, the holder 4, the intermediate member 5 and the cylindrical member 6 are integral with one another. A compression spring 8 is accommodated within the space between the outer periphery of the cylindrical member 6 and the main body 7 to downwardly bias the flanged portion 6*a* of the cylindrical member 6. The main body 7 is provided with stop means 7*a* for the cylindrical member 6.

Description will now be made of the operation of the spotting device where a lens 9 is supported on a supporting table of the lens meter 10.

As the main body 7 is moved downwardly, the central spotter 1*b* of the three spotters 1*a*, 1*b* and 1*c* first comes into contact with the lens 9. More particularly, the spotting member 2 of the spotter 1*b* comes into contact with the lens 9, and as the main body 7 is moved further downwardly, the second pillar portion 2*c* at the end of the spotting member is compressed as much as it comes into the holder 4. As the main body 7 is moved still further downwardly, the end of the holder 4 comes into contact with the lens 9. Further downward movement of the main body 7 causes the holder 4, the intermediate member 5 and the cylindrical member 6 to slide together with respect to the main body 7 against the bias of the spring 8. The spotters 1*a* and 1*c* on the opposite side now come into contact with the lens 9. Thus, even if the lens 9 is of a small radius of curvature, as shown in FIG. 1, the spotters 1*a*, 1*b* and 1*c* are moved independently of one another and positively spot the lens without injuring the latter.

As will be apparent from the foregoing, the holder in the present spotting device has the intrinsic function of holding the end of the porous rubber member to reinforce the porous rubber and in addition, the function of touching the lens 9 to permit upward escape of the entire spotter and therefore, the spotting device of the present invention can positively spot any lens irrespective of its radius of curvature, without injuring the lens. This holder 4 should desirably be formed of synthetic resin.

If ink is exhausted in the ink reservoir member 3, the entire spotter may be easily interchanged by releasing the engagement between the external thread on the intermediate member 5 and the internal thread on the cylindrical member 6, and this is very convenient.

The significances of the above-described shape of the spotting member 2 will not be discussed.

The diameter of the first pillar portion 2*a* may preferably be great in respect of the strength of the spotting member 2 and also in order to increase the quantity of ink stored and the transfer characteristic of the ink. The diameter of the lower end of the second pillar portion 2*c* is determined by the size of the spot to be formed and is much smaller than the diameter of the first pillar portion. If the length of the second pillar portion 2*c* is too short, it would permit the end of the holder 4 to touch the lens to prevent spotting when it is desired to spot the lens 9 at a point deviated from the center thereof and therefore, the second pillar portion must be long enough to avoid such situation. Conversely, too great a length of the second pillar portion would result in a weakened strength of this portion. Therefore, the length of the second pillar portion is determined with these two factors taken into consideration.

The conical portion 2*b* is provided in order that, where the spotting is to be effected on a curved surface like a lens surface, the holder 4 may not interfere with the contact between the end of the spotting member 2 and the surface of the lens 9. Also, the taper of the conical portion 2*b* is useful to enable the ink flowing out through the communication pores 20 exposed on the conical portion to be smoothly supplied into the second pillar portion 2*c*, as already noted.

In the embodiment shown in FIG. 2, the dimensions of each spotting member may preferably be determined as follows. Let $d_2$ be the diameter of the first pillar portion 2*a*, $\theta$ be the angle of taper of the conical portion 2*b*, $d_1$ be the diameter of the second pillar portion 2*c*, and h be the height of the second pillar portion 2*c*. It is desirable that the shape of the spotting member 2 should substantially satisfy the following conditions:

$$4\ \text{mm} \leqq d_2 \leqq 5\ \text{mm}$$

If the lower limit of this condition is exceeded, the quantity of ink stored will be too small. If the upper limit is exceeded, the distance between the spotting members 2 will be too much expanded, thus resulting in too great a size of the device.

$$45° \leqq \theta \leqq 75°$$

If the lower limit of this condition is exceeded, separation of the spotting member from a mold will be difficult during the manufacture. If the upper limit is exceeded, where the curvature of the lens is sharp, the holder 4 may come into contact with the lens 9 before the second pillar portion 2*c* touches the lens 9.

$$0.6\ \text{mm} \leqq d_1 \leqq 0.9\ \text{mm}$$

If the lower limit of this condition is exceeded, the mechanical strength of the spotting member will be so poor as to readily permit cracking of the second pillar portion 2*c*. If the upper limit is exceeded, the size of the spot formed will be too large.

$$0.6\ \text{mm} \leqq h \leqq 0.9\ \text{mm}$$

If the lower limit of this condition is exceeded, where the curvature of the lens is sharp, the holder 4 may come into contact with the lens 9 before the second pillar portion 2*c* touches the lens 9. If the upper limit is exceeded, the mechanical strength of the spotting member will be poor.

However, the lower end portion of the holder 4 holds the second pillar portion 2*c* in such a manner that it surrounds this pillar portion 2*c* at a distance of 0.4 mm from the end thereof.

Also, as already noted, the holder 4 holds the second pillar portion 2*c* so as to prevent deviation of the spotting position and to reinforce the mechanical strength of that portion.

Figure 3:
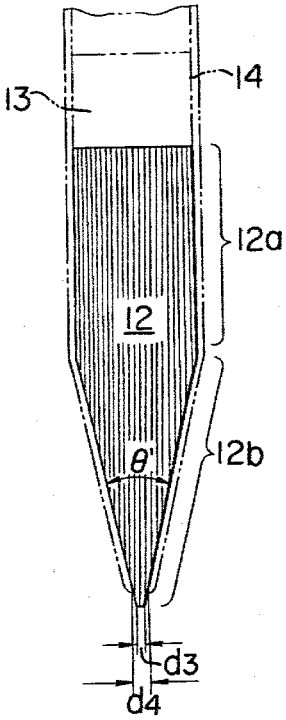
FIG. 3 is an enlarged cross-sectional view showing the shape of the spotting device according to a second embodiment of the present invention.

FIG. 3 shows a second embodiment. In this embodiment, if the shapes of the spotting member 12 and the holder 14 are determined as follows, the second pillar portion 2*c* of the spotting member 2 in the first embodiment may safely be eliminated.

First, the end portion of the holder 14 indicated by phantom lines holds the conical portion 12*b* so as to surround this portion at a predetermined distance from the end thereof. Let $d_3$ be the diameter of the end of the conical portion 12*b*, $d_4$ be the inside diameter of the end of the holder 14, and $\theta'$ be the angle of taper of the conical portion 12*b*. Then, during spotting, the conical portion 12*b* will be contracted by the spotting pressure so that the size of the formed spot will not be $d_3$ but will become a size equal to the inside diameter $d_4$ of the opening end of the holder 14. Therefore, in order that the size of the spot may be 0.6 mm to 0.9 mm as in the first embodiment, $d_4$ must satisfy the condition that $0.6\ \text{mm} \leqq d_4 \leqq 0.9\ \text{mm}$ and $d_3$ must be less than 0.6 mm. Correspondingly, the tapered portion should be longer, the angle $\theta'$ should be smaller and the length of the tapered portion which is exposed beyond the end of the holder 14 should be 0.4 mm, as already described.

The present invention, as described above, employs a porous material such as porous rubber which permits the use of oil ink less ready to dry. This leads to the provision of a spotting device for lens meter which eliminates the cap heretofore required for the prevention of drying of ink and which can be automatically supplied with ink and ensure spots of equal size to be formed on lenses.

In any of the two embodiments described, the ink reservoir member and the spotting member are cylindrically shaped, but this is not always restrictive.

Further, the ink reservoir member may be formed of any material which can store ink therein, but it has been empirically found that porous material such as polyvinyl formal resin is best suited in respect of the reservability and shiftability of ink.

What I claim is:

1. A spotting device for use with a lens meter, comprising:

means for supporting a lens in a predetermined position;

spotting means for spotting said lens with ink, said means including a plurality of hollow cylinders each having a small aperture at an end thereof;

means for holding said hollow cylinders in parallelism to one another and for sliding movement axially thereof towards and away from said supporting means and independently of one another;

means defining an ink reservoir disposed within each of said hollow cylinders for containing ink therein;

a porous member for spotting said lens, said porous member being disposed within each of said hollow cylinders with one end thereof communicating with said ink reservoir and the other end projected from said small aperture, said porous members each being formed of a resilient material permitting axial compression thereof into the aperture of its respective hollow cylinder and having a number of communication pores for directing said ink therethrough from said one end to said other end; and bias means provided to impart a biasing force to each of said hollow cylinders in the direction toward said end thereof, said biasing force being greater than the resilient force of said porous members exerted when said other end of a porous member is compressed into its respective cylinder, said biasing means thus permitting retraction of its respective cylinder relative to said holding means when a respective porous member having spotted said lens, is compressed and said lens is then contacted by the apertured end of said cylinder under a force greater than said biasing force.

2. A device according to claim 1, wherein said spotting member comprises a pillar portion in contact with said ink reservoir member, and a tapered portion formed so that one end thereof is projected from said small aperture of said hollow cylinder.

3. A device according to claim 1, wherein said spotting member comprises a first pillar portion in contact with said ink reservoir member, a second pillar portion projected from said small aperture of said hollow cylinder and thinner than said first pillar portion, and a tapered portion formed between said two pillar portions.

4. A device according to claim 1, wherein each said hollow cylinder is tapered adjacent to the end thereof, and said small aperture is formed at the end of said taper.

5. A device according to claim 1, wherein each said spotting member has a circular cross-section, the diameter of said one end of each said spotting member is 4 to 5 mm, and the diameter of the cross-section of that portion of each said spotting member containing said other end which is projected from said small aperture of said hollow cylinders is about 0.6 to about 0.9 mm.

6. A device according to claim 3, wherein said tapered portion has a gradient ranging from about $\tan^{-1}$ 22.5° to about $\tan^{-1}$ 37.5°.

7. A device according to claim 5, wherein said other end of said spotting member is projected by about 0.4 mm outwardly of said hollow cylinder through said small aperture thereof.

* * * * *